US009748645B2

(12) United States Patent
Mohamadi

(10) Patent No.: US 9,748,645 B2
(45) Date of Patent: Aug. 29, 2017

(54) RECONFIGURABLE ANTENNA WITH CLUSTER OF RADIATING PIXELATES

(71) Applicant: Farrokh Mohamadi, Irvine, CA (US)

(72) Inventor: Farrokh Mohamadi, Irvine, CA (US)

( * ) Notice: Subject to any disclaimer, the term of this patent is extended or adjusted under 35 U.S.C. 154(b) by 654 days.

(21) Appl. No.: 14/147,319

(22) Filed: Jan. 3, 2014

(65) Prior Publication Data

US 2016/0218425 A1 Jul. 28, 2016

Related U.S. Application Data

(60) Provisional application No. 61/831,049, filed on Jun. 4, 2013, provisional application No. 61/835,362, filed on Jun. 14, 2013.

(51) Int. Cl.

| | |
|---|---|
| ***H01Q 3/24*** | (2006.01) |
| ***H01Q 21/00*** | (2006.01) |
| ***H01Q 21/06*** | (2006.01) |
| ***H01Q 21/24*** | (2006.01) |
| *H01Q 3/36* | (2006.01) |

(52) U.S. Cl.

CPC ..... *H01Q 3/24* (2013.01); *H01Q 21/0025* (2013.01); *H01Q 21/0031* (2013.01); *H01Q 21/062* (2013.01); *H01Q 21/065* (2013.01); *H01Q 21/245* (2013.01); *H01Q 3/36* (2013.01)

(58) Field of Classification Search

CPC ..... H01Q 3/24; H01Q 9/0407; H01Q 3/01; H01Q 9/16; H01Q 1/50; H01Q 9/0428

USPC ..... 343/700 MS, 909

See application file for complete search history.

(56) References Cited

U.S. PATENT DOCUMENTS

| | | | | |
|---|---|---|---|---|
| 4,807,003 | A | 2/1989 | Mohamadi et al. | |
| 6,870,503 | B2 | 3/2005 | Mohamadi | |
| 6,885,344 | B2 | 4/2005 | Mohamadi | |
| 6,885,345 | B2 * | 4/2005 | Jackson | H01Q 3/40 343/700 MS |
| 6,963,307 | B2 | 11/2005 | Mohamadi | |
| 6,982,670 | B2 | 1/2006 | Mohamadi | |
| 7,042,388 | B2 | 5/2006 | Mohamadi | |
| 7,126,541 | B2 | 10/2006 | Mohamadi | |
| 7,126,542 | B2 | 10/2006 | Mohamadi | |
| 7,126,554 | B2 | 10/2006 | Mohamadi | |
| 7,312,763 | B2 | 12/2007 | Mohamadi | |
| 7,321,339 | B2 | 1/2008 | Mohamadi | |
| 7,352,324 | B2 | 4/2008 | Mohamadi | |
| 7,358,848 | B2 | 4/2008 | Mohamadi | |
| 7,414,577 | B2 | 8/2008 | Mohamadi | |
| 7,420,524 | B2 * | 9/2008 | Werner | H01Q 1/38 343/700 MS |
| 7,423,607 | B2 | 9/2008 | Mohamadi | |
| 7,542,005 | B2 | 6/2009 | Mohamadi | |

(Continued)

*Primary Examiner* — Huedung Mancuso

(74) *Attorney, Agent, or Firm* — Haynes and Boone, LLP

(57) ABSTRACT

Similar to cell based electronics systems that employ a sea of small unit cells in large scale arrays, such as thin film display monitors or semiconductor memories, an antenna array employs micron to centimeter size antenna pixelate cells that are integrated to form the plate of an antenna. Each row and column of cells in the antenna array may be accessed by digital logic and the RF transmission/reception state of the switchable cell changed. Thus, the antenna plate can be reconfigured and its radiating plate reformed to a specific pattern as an element of a larger array of antennas in wafer scale form.

19 Claims, 15 Drawing Sheets

(56) References Cited

U.S. PATENT DOCUMENTS

| | | | | |
|---|---|---|---|---|
| 7,548,205 | B2 | 6/2009 | Mohamadi | |
| 7,554,504 | B2 | 6/2009 | Mohamadi | |
| 7,610,064 | B2 | 10/2009 | Mohamadi | |
| 7,679,563 | B2 * | 3/2010 | Werner | H01Q 15/002 343/700 MS |
| 7,683,852 | B2 | 3/2010 | Mohamadi | |
| 7,697,958 | B2 | 4/2010 | Mohamadi | |
| 7,701,379 | B2 | 4/2010 | Niktash | |
| 7,728,784 | B2 | 6/2010 | Mohamadi | |
| 7,750,860 | B2 | 7/2010 | Mohamadi | |
| 7,760,018 | B2 | 7/2010 | Ardehali | |
| 7,782,111 | B2 | 8/2010 | Ardehali | |
| 7,791,556 | B2 | 9/2010 | Mohamadi | |
| 7,830,989 | B2 | 11/2010 | Mohamadi | |
| 7,839,283 | B2 | 11/2010 | Mohamadi | |
| 7,843,992 | B2 | 11/2010 | Mohamadi | |
| 7,855,695 | B2 | 12/2010 | Mohamadi | |
| 7,884,776 | B2 | 2/2011 | Mohamadi | |
| 7,965,249 | B1 * | 6/2011 | Wolf | H01Q 9/0442 343/700 MS |
| 8,154,339 | B2 | 4/2012 | Zolghadri et al. | |
| 8,237,604 | B2 | 8/2012 | Mohamadi et al. | |
| 2004/0201526 | A1 * | 10/2004 | Knowles | H01Q 1/38 343/700 MS |

* cited by examiner

RECONFIGURABLE ANTENNA WITH CLUSTER OF RADIATING PIXELATES

CROSS REFERENCE TO RELATED APPLICATIONS

This application claims the benefit of priority from U.S. Provisional Patent Application No. 61/831,049, filed Jun. 4, 2013, and 61/835,362, filed Jun. 14, 2013, both of which are incorporated by reference.

BACKGROUND

The present disclosure generally relates to radio frequency (RF) antennas and, more particularly, to electronically reconfigurable antennas that can be used, for example, for radar sensing and RF communications.

The currently typical approach of phased array antenna design practices and implementing antenna array technologies may be characterized as "siloed" array system development, procurement, and sustainment that is heavily compartmentalized. Instead of a large undertaking focusing on a traditional, monolithic array system, an approach is needed that can be implemented in elemental and large scale integration.

Transmit-receive (TX-RX) antenna arrays tend to constitute a highly targeted one-off design effort that produces a unique product for each application with little consideration for design re-use. An approach that is scalable and customizable for each application, without a full redesign for each application space is needed in which as much as 70% to 80% of an array's development cycle cost is built-in, in the sense that re-use of previously existing components and design can save 70% to 80% compared to a one-off design that produces a unique product application.

Figure 1:
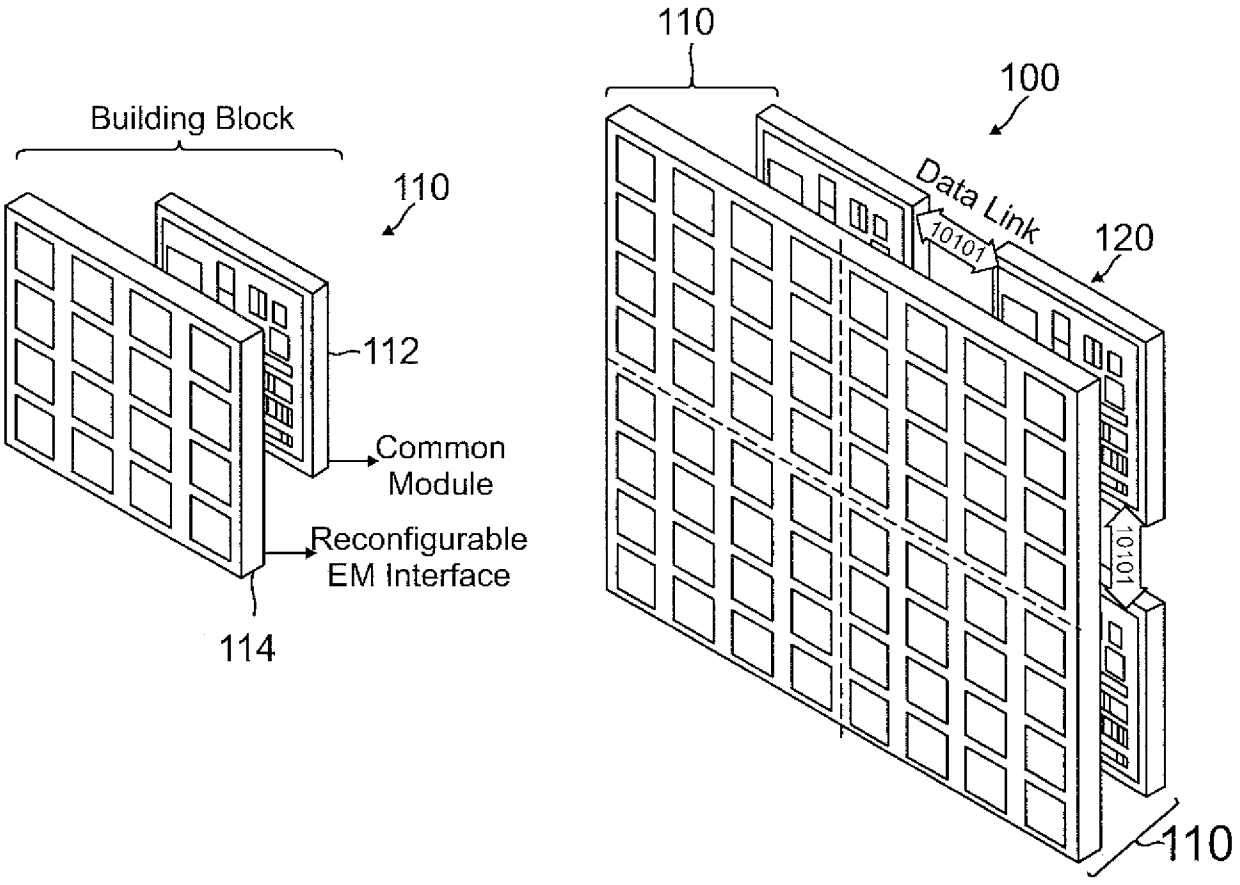
FIG. 1 is a perspective diagram illustrating a system for building modular reconfigurable antenna arrays, in accordance with one or more embodiments.

Embodiments of the present disclosure and their advantages are best understood by referring to the detailed description that follows. It should be appreciated that like reference numerals are used to identify like elements illustrated in one or more of the figures, in which the showings therein are for purposes of illustrating the embodiments and not for purposes of limiting them.

DETAILED DESCRIPTION

Methods and systems are disclosed to address the need for real-time modifiable antenna elements for reconfigurable antennas that are customizable for each application and can be implemented from separable building block modules so that customized antenna array designs are scalable for each application.

Embodiments address implementation of digitally-interconnected radio frequency (RE) pixelate cells (e.g., one or more antenna radiating elements and controlling switches, also referred to as "pixelates" or "radiating pixelates") that form a pixelated antenna plate, hence, its radiation pattern. As an element of a building block, a wafer scale integration of reconfigurable pixelated antenna patterns can form the larger systems for various operational applications. One or more building blocks can form the reconfigurable electromagnetic (EM) interface, which is scalable and customizable for each application, without a full redesign for each application space.

Various embodiments may incorporate teachings from a number of wafer scale antenna module (WSAM) and switchable antenna patents, including U.S. Pat. No. 7,884,776, issued Feb. 8, 2011, entitled "High Power Integrated Circuit Beamforming Array"; and U.S. Pat. No. 7,750,860, issued Jul. 6, 2010, entitled "Helmet Antenna Array System", which are incorporated by reference.

The portion of the building block 110 (see FIG. 1) which is the shared asset, the common module 112, may encompass functionality that is common across many applications and can be viewed as a constituent unit of the more complex system 100. More specifically, the common module 112 may build upon recent developments in transition to digitally-architected RF arrays. The larger digital influence within the RF system potentially enables an unprecedented level of commonality between systems and across application requirements. Given a similar digital impact on phased arrays, there exists a path toward economies of scale. By correctly architecting data flows within the array (e.g., system 100), the common module 112 may underpin several customizable array applications sharing common underlying hardware. For a system reacting to a new input from the environment, this underlying reconfigurable antenna pattern approach may allow for a rapid response when a system need is outside of existing hardware capabilities. The reconfigurable antenna pattern approach may also support quick and simplified developments of system variants that enable antenna systems to be widely adaptable to field requirements and difficult to counter in an adversarial environment.

One or more embodiments may include one or more of:

1) implementation of a fully integrated matrix of metallic cells that can be elementally transmitting or terminating routing of an RF signal to air so that embodiments may provide implementation of one antenna that can be formed to many antenna shapes;
2) wafer scale integration of such a reconfigurable antenna pattern array to form wafer scale antenna arrays with beam forming and spatial power combining capabilities;
3) implementation of configurable array of patch based reconfigurable antenna patterns to act as an element of a wafer scale (e.g., the maximum dimension of the antenna array is less than 18 inches) antenna module (WSAM) with right hand circularly polarized (RHCP), left hand circularly polarized (LHCP), vertical, horizontal, or linear polarization performance;
4) implementation of configurable array of Ring based reconfigurable antenna patterns to act as an element of a WSAM with RHCP, LHCP, vertical, horizontal, or linear polarization performance;
5) implementation of configurable array of Dipole based reconfigurable antenna patterns to act as an element of a WSAM with RHCP, LHCP, vertical, horizontal, or linear polarization performance;
6) implementation of configurable array of reconfigurable antenna patterns to act as an element of a single or multiple frequency transmitter and receiver;
7) implementation of configurable array of reconfigurable antenna pattern s to act as an element of a single or multiple antenna multiple-input-multiple-output (MIMO) system;
8) implementation configurable array of reconfigurable antenna patterns to act as an element of a WSAM with variable phase and amplitude capability such that beam steering and beam shaping functions can be addressed on-the-fly and in real-time;
9) wafer scale reconfigurable antenna pattern's row and column select function using full latch and half latch addressing scheme;
10) wafer scale reconfigurable antenna pattern's row and column selected pixelate cells may be turned on and off using a non-volatile memory and field programmable gate array (FPGA) arrangement;
11) wafer scale reconfigurable antenna patterns use RF switch with termination;
12) wafer scale reconfigurable antenna patterns' cells may be coupled electromagnetically;
13) wafer scale reconfigurable antenna patterns' cells may be coupled electrically;
14) wafer scale reconfigurable antenna patterns' cells may be coupled electrically in X-Y directions;
15) wafer scale reconfigurable antenna patterns' cells may be coupled electrically in Z direction;
16) wafer scale reconfigurable antenna pattern's implementation on a wafer;
17) wafer scale reconfigurable antenna pattern's implementation as a scalable chip;
18) method of manufacturing wafer scale reconfigurable antenna pattern using multi-layer board and multi-layer metal stacks;
19) method of manufacturing wafer scale reconfigurable antenna pattern using a semiconductor integrated circuit process;
20) method of manufacturing wafer scale reconfigurable antenna pattern using a 4 layer metal, single poly silicon-on-insulator (SOI) and back etch process;
21) method of manufacturing wafer scale reconfigurable antenna pattern using a 4 layer metal, single poly SOI and back etch process, and special cell plate metallization scheme;
22) wafer scale array module using wafer scale reconfigurable antenna pattern as its elements;
23) method of routing the metallization to feed each wafer scale reconfigurable antenna pattern with the RF signal;
24) phase management of each wafer scale reconfigurable antenna pattern to be synchronized as an antenna element;
25) real-time configuration software capability to alter the state of a wafer scale reconfigurable antenna pattern;
26) implementation of one antenna that can be formed to many antenna shapes;
27) instantaneous re-shaping of the antenna, hence, an array of wafer scale reconfigurable antenna patterns to form RHCP, LHCP, or other polarizations based on programming a micro controller;
28) highly flat compact configurable wireless communication system based on wafer scale reconfigurable antenna pattern;
29) highly flat compact configurable radar system based on wafer scale reconfigurable antenna pattern;
30) highly flat compact configurable sonar system based on sonar transducer analogous to wafer scale reconfigurable antenna pattern;
31) highly conformal configurable system based on wafer scale reconfigurable antenna pattern concept; and
32) conformal flexible material stamped configurable system based on wafer scale reconfigurable antenna pattern concept.

FIG. 1 illustrates a system 100 built from modular reconfigurable antenna array building blocks 110, in accordance with one or more embodiments. As shown on the left in FIG. 1, each building block 110 may include a common module 112 and a reconfigurable electromagnetic interface 114. In a reconfigurable antenna pattern based approach to antenna array development, building block array panels 110 that are common for a wide variety of array applications may be connected into a large antenna array 120 built from interconnected building block array panels 110. The common module 112 enables translating RF or IF inputs to digital beams with sufficient processing to create a manageable data flow among sub-arrays. The common module 112 allows operating as part of an overall system 100 that facilitates interconnection and scalability of the array panels 110 to form larger array systems 100. A need in the art for asymmetry in the electromagnetic domain can be satisfied through adaptation of a common module 112 that can be rapidly refreshed to take advantage of improving IC technologies. The reconfigurable antenna pattern based building block array panels 110 may scale not only to form larger arrays 120 within a typical platform area, but also may scale across platforms to generate coherent, spatially distributed radiation. In applications where size and weight are a premium, arrays typically maximize power density in a fixed physical footprint to maximize range. This approach necessitates the leading edge of technical capabilities, which can delay fielding a system and increase cost. The reconfigurable antenna pattern approach is adaptable so that building block array panels 110 can be stitched together ad hoc as if they were nodes on a network. While transferring data in the digital domain is often accomplished over fiber, the timing and coordination of several arrays can be accomplished spatially. The reconfigurable antenna pattern approach is amenable to wireless time transfer and real time localization of spatially distributed arrays that can achieve coherent power aggregation.

Figure 2A:
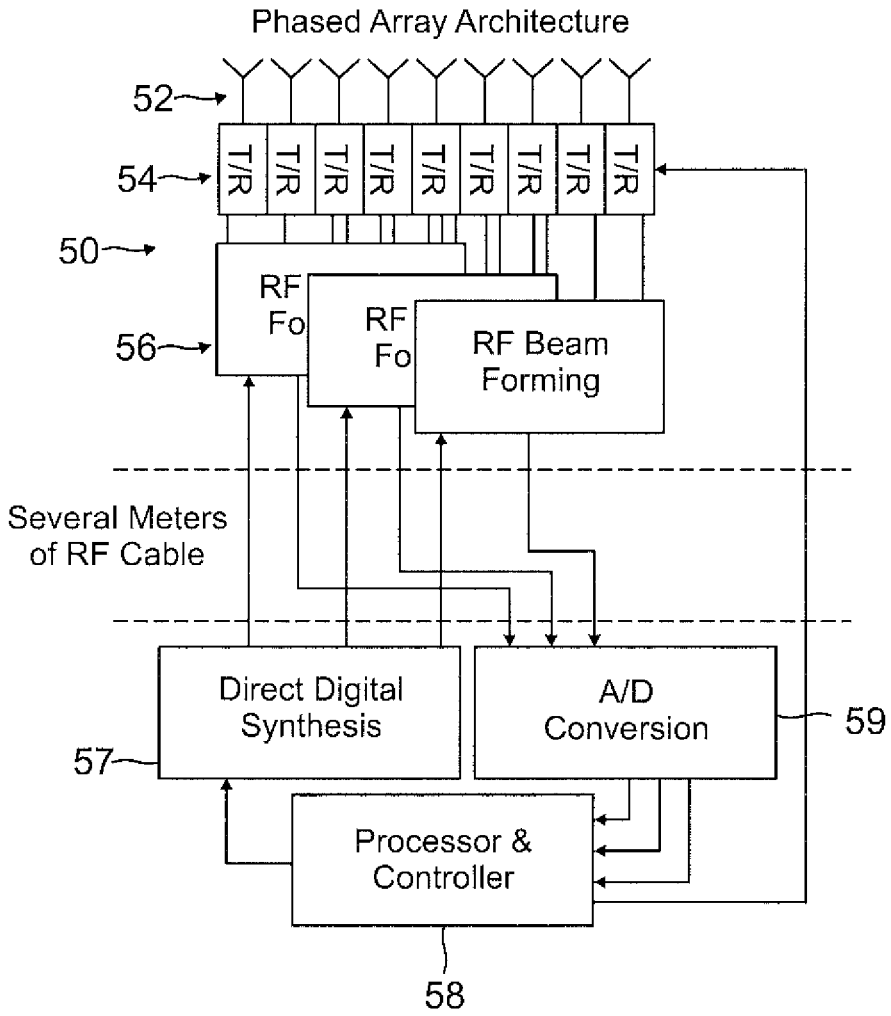
FIGS. 2A and 2B are a pair of system block diagrams comparing system architectures for a non-modular phased array antenna architecture (FIG. 2A) with a modular phased array antenna architecture (FIG. 2B) according to one embodiment.
Figure 2B:
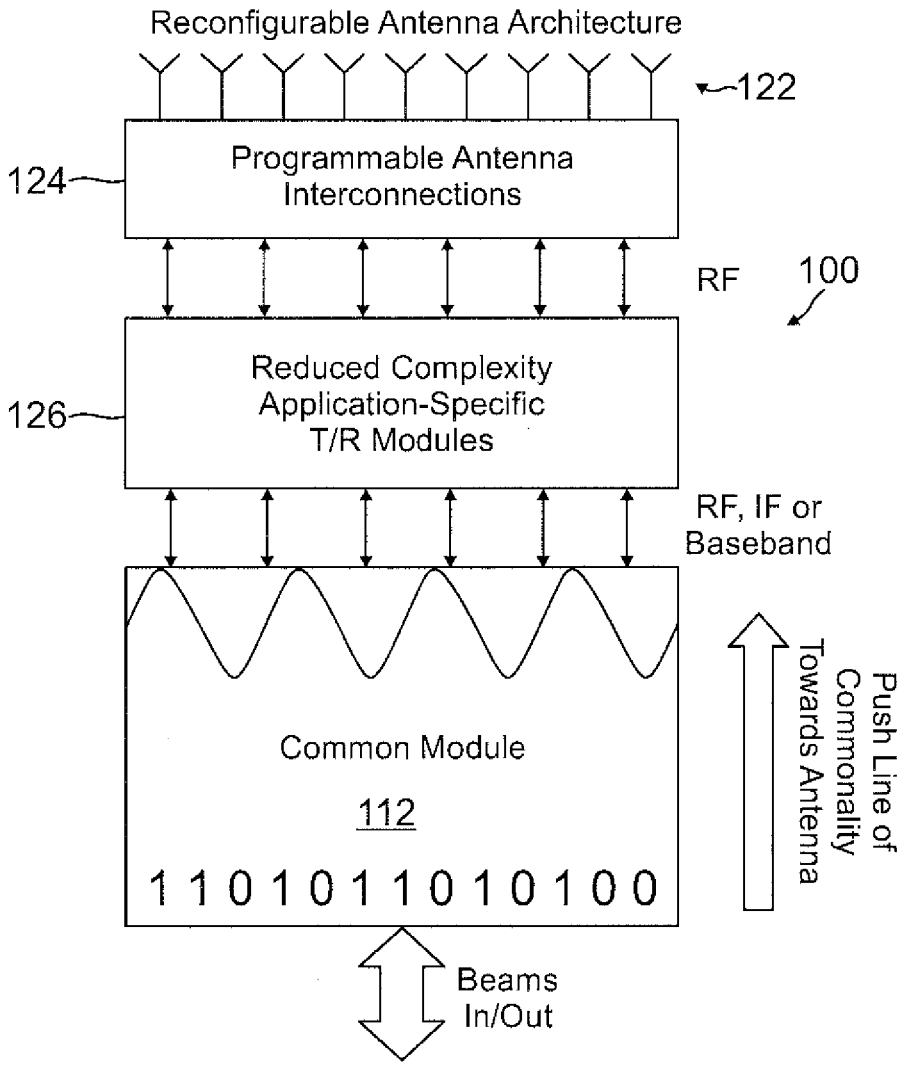

FIGS. 2A and 2B illustrate system architectures for a system 50 for a non-modular phased array antenna architecture (FIG. 2A) and for system 100 with a modular phased array antenna architecture (FIG. 2B). System 50 may include antenna radiating elements 52, transmit-receive modules 54, connected to antenna radiating elements 52 as shown, RF beam forming modules 56, connected to control various subsets of antenna radiating elements 52 as shown for phased array beam forming, and processor and control module 58 with direct digital synthesis module 57 and analog-digital conversion module 59 for signal processing and control of signal transmission and reception.

System 100, based on reconfigurable antenna pattern approach, may include antenna radiating elements 122, each of which may include multiple segments, e.g., ring segments, antenna patches, or dipoles, for example (that may be analogous to subpixels of panel display), and each antenna element 122 may have its segments switched into a reconfigurable antenna pattern (that may be analogous to pixels of panel display). System 100 may include programmable antenna interconnections module 124, connected to antenna radiating elements 122 as shown, for controlling shaping of antenna segments into reconfigurable antenna patterns by switching segments of each reconfigurable antenna pattern between transmit-receive and terminate (also referred to as "turning a segment or element on or off"). System 100 may include transmit-receive modules 126, connected to programmable antenna interconnections module 124 as shown, that may be application specific and may have reduced complexity in comparison to transmit-receive modules 54. System 100 may include common module 112 connected to transmit-receive modules 126 as shown and as described above.

With an architecture such as that illustrated for system 100, reconfigurable antenna pattern systems may enable real-time digital management so that an array (e.g., array 120) can be built upon for the common module 112 that in turn can be "personalized" for a specific end use. Metrics embedded in the application-specific "personality" include the frequency, bandwidth, polarization, power level, scan angle, geometry, beam characteristics (width, scan rate, etc.), and number of elements. Any unique combination of these parameters may be considered a personality. The reconfigurable antenna pattern approach may enable a personality for an application-specific system surrounding the common module 112 to be created and adapted in minutes as opposed to years. For example, using reconfigurable antenna pattern approach may enable development of a reconfigurable electromagnetic interface (e.g., EM interface 114) that will limit the impact of the initial design choices so that an antenna can be modified in the field to changing specifications. FIG. 2 depicts a more common architecture 50 and reconfigurable antenna pattern based phased array architecture 100 showing the possible demarcations between the RF personality and the common module.

Figure 3A:
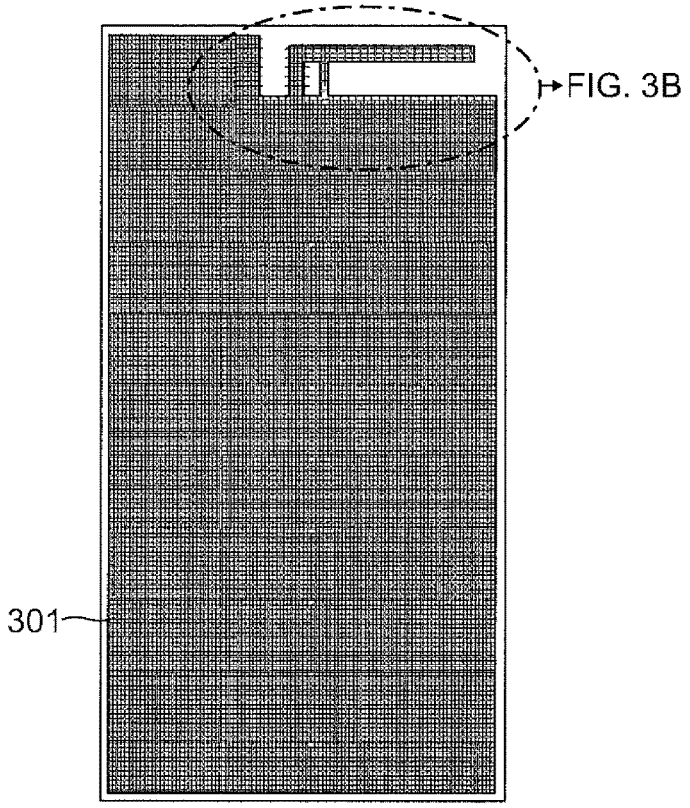
FIGS. 3A and 3B are design layout diagrams illustrating an example of implementing an inverted-F antenna (FIG. 3A) using reconfigurable antenna elements (FIG. 3B), in accordance with an embodiment.
Figure 3B:
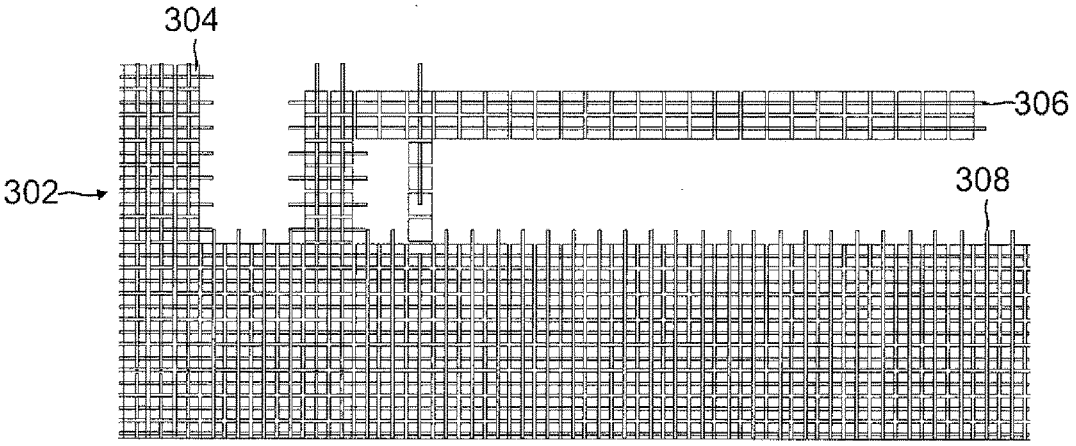

FIGS. 3A and 3B illustrate an example of layouts of an inverted-F antenna as a single plate antenna element 301 (FIG. 3A) and as a reconfigurable antenna pattern antenna element 302 using switchable pixel segments or pixelate cells 304 (FIG. 3B) that are selectable by rows 306 and columns 308. FIG. 3B is shown at an increased scale compared to FIG. 3A and, thus, shows only the top portion of antenna element 302 corresponding to antenna element 301 shown in FIG. 3A. FIG. 3B illustrates how the single antenna element 301 can be split or broken into 4,482 sub-antenna cells 304, each comprising a switchable radiating plate about 1000 microns×1000 microns in size, for independent real time re-shaping of the radiating element, in this example, antenna element 302.

FIGS. 4A, 4B, 4C, 4D, 4E, 4F, 4G, and 4H are physical layout diagrams illustrating signal routing to antenna radiating elements, in accordance with one or more embodiments.

Figure 4A:
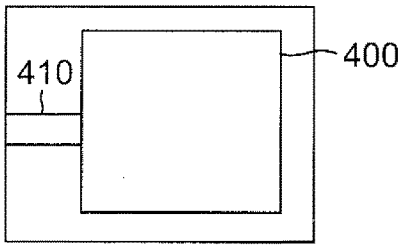
FIGS. 4A, 4B, 4C, 4D, 4E, 4F, 4G, and 4H are physical layout diagrams illustrating signal routing to antenna radiating elements, in accordance with one or more embodiments.
Figure 4B:
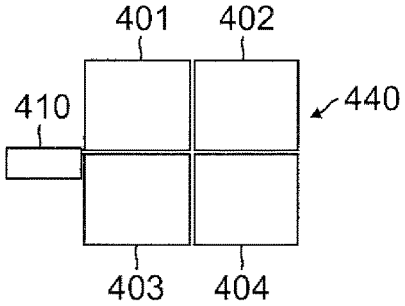

FIGS. 4A and 4B present a simplified example of the principle behind the design of reconfigurable antenna pattern as an element of radiation for large scale antenna array development. FIG. 4A is a single (solid) patch antenna 400 for illustration. FIG. 4B shows that the single patch antenna 400 of FIG. 4A can be split into 4 sub-antenna cells (switchable radiating plates or radiating pixel elements) 401, 402, 403, 404 for independent real time re-shaping of the radiating element 440 (reconfigurable antenna pattern). Each of cells 401-404 may be connected to RF signal feed controlling switch 410 by a metal routing or feed line 411, 412, 413, and 414, for each of cells 401-404 respectively to implement switchable radiating plates.

Figure 4C:
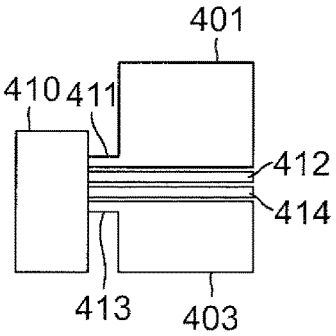
Figure 4D:
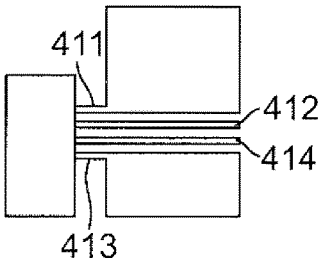
Figure 4E:
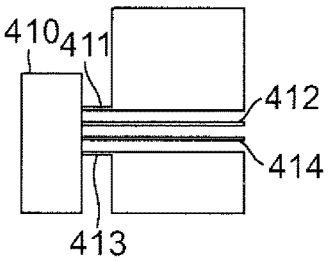

As seen in each of FIGS. 4B-4E, metal routing 411-414 may be controlled by the switch 410 to route the RF signal to the proper channel for implementation of a 2×2 reconfigurable antenna pattern radiating element 440. To demonstrate the impact of thickness of metal routing 411-414 on performance of reconfigurable antenna pattern radiating element 440, three different widths of 25 to 75 micron metal with 100 micron pitch (spacing one from another) are shown in FIGS. 4C, 4D, and 4E. As can be seen (for example, in the graph shown in FIG. 5) the impact of pitch is minimal, however, important. In the example, a wide metal width has been used; if, however, the implementation is on a semiconductor process, metal widths as small as a fraction of a micron can be used; hence, a significant number of elements may have a small impact on the reconfigurable antenna pattern's performance.

Figure 4F:
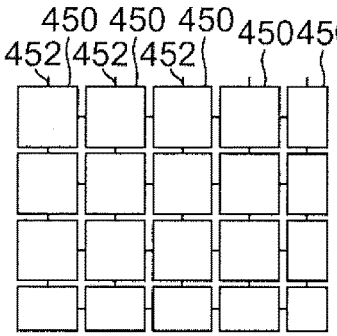
Figure 4G:
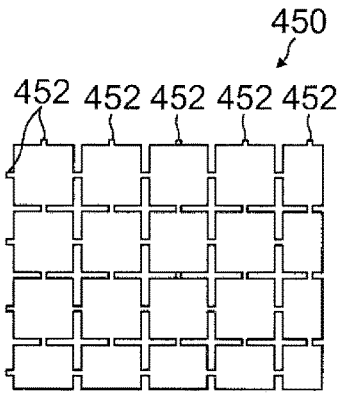
Figure 4H:
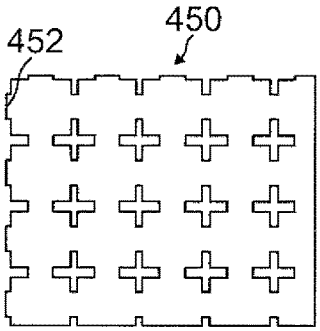

FIGS. 4F, 4G, and 4H show another example of the impact of metal pitch for the column and row selection of reconfigurable antenna pattern switchable cells 450. FIGS. 4F, 4G, and 4H illustrate the reduced size of each cell 450 to 900 microns×900 microns, where there will be 200 microns of passive area for column selection and row selection metal routing. FIGS. 4F, 4G, and 4H also present the metal routing impact on the switch selection that is controlled by the row and column decoder and encoders with will activate clusters of switches to route the RF signal through proper channels or eliminate it by matching it to ground. FIG. 4F illustrates 1 micron metal pitch of metal routing 452 for the column and row selection of each cell 450, FIG. 4G illustrates 100 microns metal pitch, and FIG. 4H illustrates 400 microns metal pitch. Similarly to what may be seen in FIG. 5 for the example given above, impact of metal pitch on reconfigurable antenna pattern radiating elements may be minimal but important.

Figure 5:
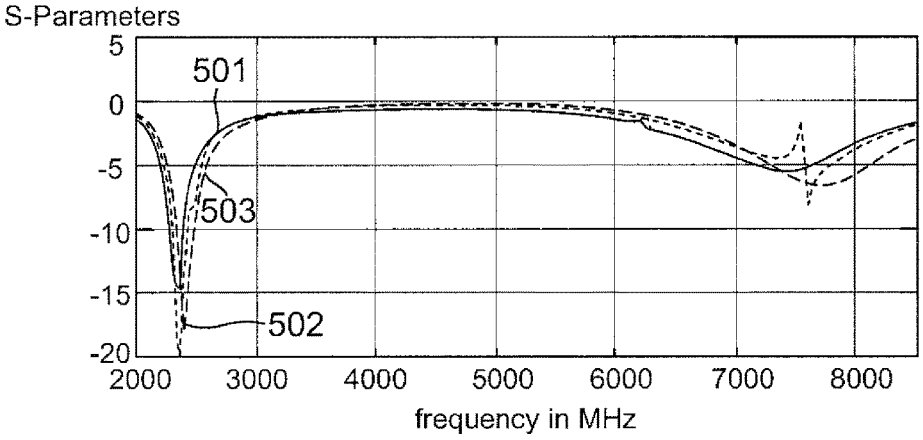
FIG. 5 is a graph of S-parameter plots illustrating the impact of metal pitch on signal routing for some of the examples shown in FIGS. 4A-4H, in accordance with one or more embodiments.

FIG. 5 is a graph of S-parameter plots illustrating the impact of metal pitch and width on signal routing for some of the examples shown in FIGS. 4A-4H, in accordance with one or more embodiments. FIG. 5 shows S11 parameter plots 501, 502, and 503 for metal routing with width of 100 microns (plot 501), 400 microns (plot 502), and no segmentation (plot 503). The S11 parameters have predictable phase shift as a result of smaller metal pitch (associated with tuning of the entire cells). As may be seen from the S11 plots shown in FIG. 5, the impact of pitch may be minimal but should be addressed in design consideration of very narrow bandwidth designs.

A key element in design and packing density of the switchable antenna cells in wafer scale reconfigurable antenna pattern's implementation is the effective on-resistance of switches when turned on to allow passing the RF signal to the neighboring cells. Similarly, the isolation effectiveness defines how well the neighboring cells are not electrically coupled. For finer resolution pixilated antenna and programmability of reconfigurable antenna pattern, fine pitch metal length and width are required. As an example a 1000 micron×1000 micron copper cell plate has a sigma (conductivity) of $5.8\times10^7$ Siemens per meter (SI), while a low conductivity tantalum nitride has about $7.4\times10^3$ SI.

FIGS. 6A, 6B, 6C, and 6D are physical layout diagrams illustrating various operating configurations for a reconfigurable antenna array 600 in accordance with an embodiment.

Figures 6A, 6B, 6C, 6D:
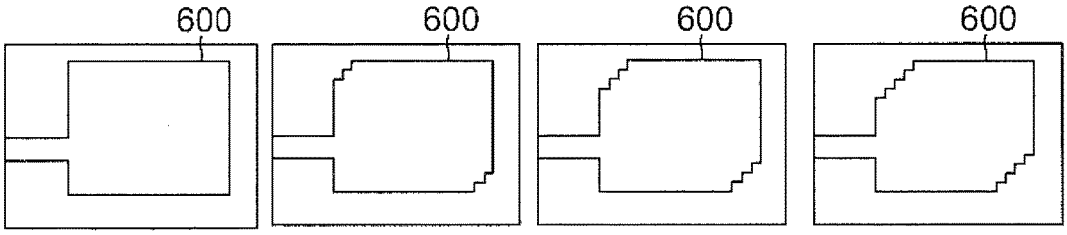
FIGS. 6A, 6B, 6C, and 6D are physical layout diagrams illustrating various operating configurations for a reconfigurable antenna array in accordance with an embodiment.

Reconfigurable antenna array 600 is an example of a patch antenna with 17×15 cells, each comprising a switchable radiating plate in the form of a small rectangle (patch, e.g., as shown in the examples of FIG. 4). To further demonstrate the impact of cell size reduction, the patch antenna 600 was designed with 17×15 cells to perform around 20 GHz center frequency. FIG. 6A, shows antenna 600 with all 17×15 cells turned on (switched to radiate the RF signal to the air); FIG. 6B shows antenna 600 with 6 cells turned off (switched, e.g., to terminate the RF signal to ground); FIG. 6C shows antenna 600 with 12 cells turned off, and FIG. 6D shows antenna 600 with 20 cells turned off. Thus, FIGS. 6A through 6D may show a sequence of turning off cells at certain locations such that a frequency shifting occurs, thus, programming different cells of reconfigurable antenna pattern antenna element 600 for frequency shift.

Figure 7:
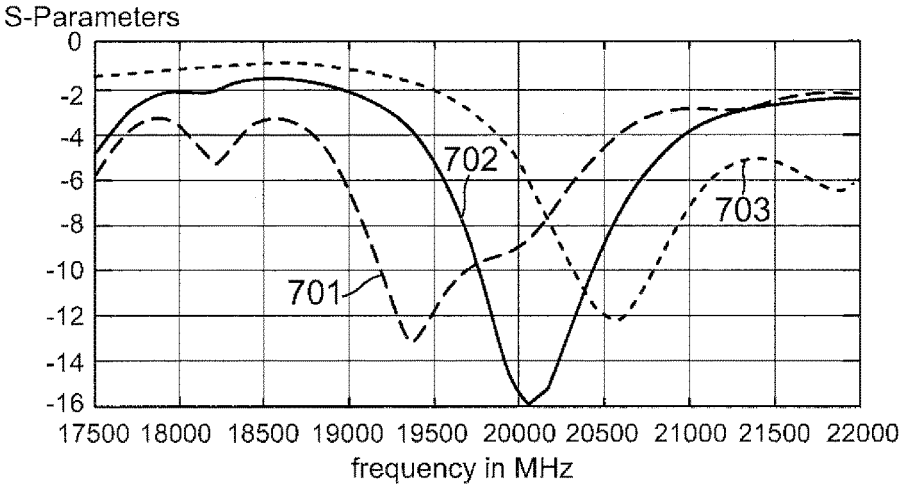
FIG. 7 is a set of S-parameter plots illustrating the effect on center frequency of various operating configurations shown in FIGS. 6B-6D in accordance with an embodiment.

FIG. 7 is a set of S-parameter plots illustrating the programming effect of turning-off cells for frequency shift on center frequency of reconfigurable antenna array 600 as illustrated by the various operating configurations shown in FIGS. 6B-6D. The impact of turning off certain cells for such behavior is shown by the graph plots of S11 parameters in FIG. 7, where, for a bandwidth of 300 MHz, the center frequency can vary as evidenced by the S11 parameters, plot 701 shows the effect of 6 cells turned off, plot 702 shows the effect of 12 cells turned off, and plot 703 shows the effect of 20 cells turned off.

Figure 8:
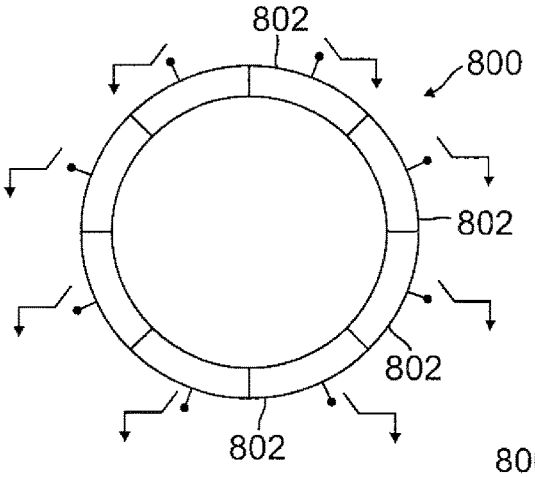
FIG. 8 is a physical layout diagram illustrating reconfigurable antenna elements arranged as a segmented annular ring in accordance with one or more embodiments.

FIG. 8 is a physical layout diagram illustrating a reconfigurable antenna pattern switchable radiating antenna element 800 arranged as a segmented annular ring of switchable ring segments (or switchable cells or pixelate cells) 802, in accordance with one or more embodiments. Annular ring reconfigurable antenna pattern 800 includes 8 switchable cells 802, shaped as ring segments rather than patches as in the previous example. Thus, reconfigurable antenna pattern approach can be expanded to address annular rings, specifically for polarization purposes. Unlike other circular polarized antenna elements known in the art, annular ring reconfigurable antenna pattern 800 is a single ultra wide band (UWB) antenna element that can be switched to perform right-hand-circular polarization (RHCP) as well as left-hand circular polarization (LHCP). Shown in FIG. 8 is an example of an annular ring reconfigurable antenna pattern 800 that has been segmented to 8 pieces (sub-cells, cells, or pixels) of 45 degrees wedge-of-pie-shaped cells.

Figure 9A:
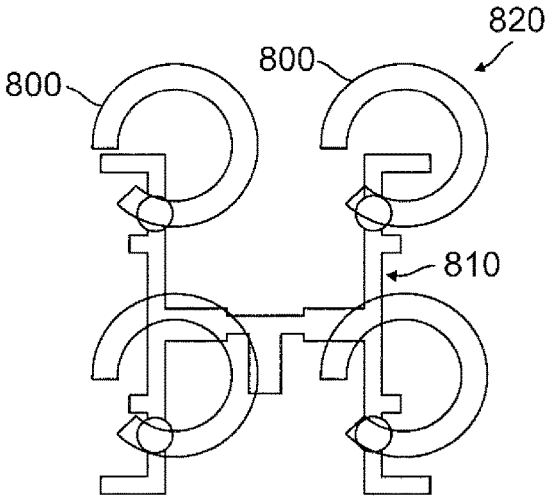
FIGS. 9A and 9B are physical layout diagrams illustrating two examples of operating configurations for an annular reconfigurable antenna array element in accordance with one or more embodiments.
Figure 9B:
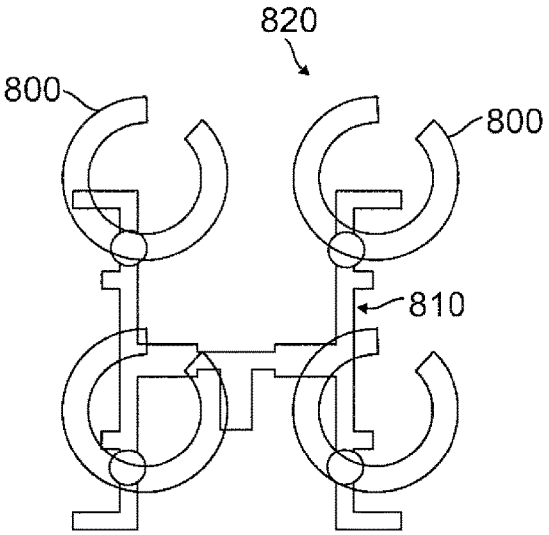

FIGS. 9A and 9B are physical layout diagrams illustrating two examples of operating configurations for a 2×2 array 820 of annular reconfigurable antenna pattern array elements 800 and their signal feed network 810 in accordance with one or more embodiments. FIG. 9A shows the antenna elements 800 with cell segments at 225-275 degrees switched off, and FIG. 9B shows the antenna elements 800 with cell segments at 0-45 degrees switched off. Effects on polarization of each configuration of reconfigurable antenna pattern switchable radiating antenna element 800 are shown in FIGS. 10A and 10B.

Figure 10A:
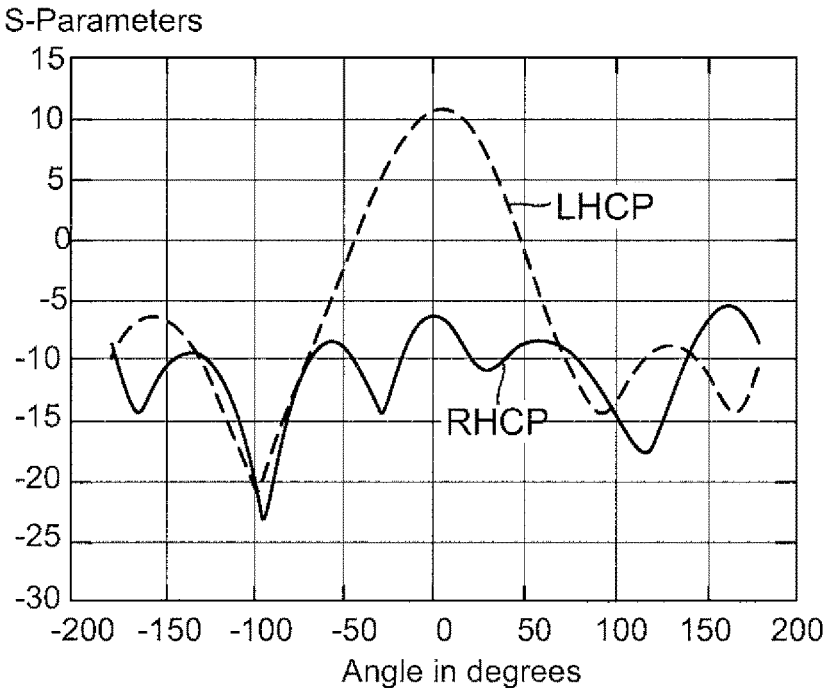
FIGS. 10A and 10B are radiation pattern graphs showing cross-polarization radiation patterns for the example operating configurations, shown in FIGS. 9A and 9B respectively, of an annular reconfigurable antenna array in accordance with one or more embodiments.
Figure 10B:
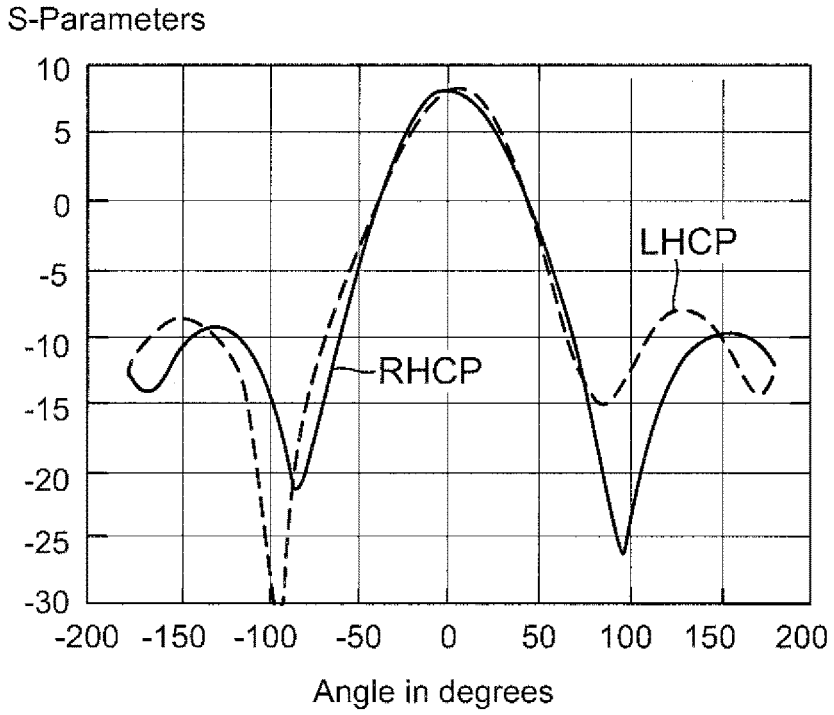

FIGS. 10A and 10B are radiation pattern graphs showing cross-polarization radiation patterns for the example operating configurations, shown in FIGS. 9A and 9B respectively, of an annular reconfigurable antenna array in accordance with one or more embodiments. As shown in FIG. 10A, the corresponding sub switching with cell segments at 225-275 degrees switched off (FIG. 9A) can produce LHCP. As shown in FIG. 10B, the corresponding sub switching with cell segments at 0-45 degrees switched off (FIG. 9B) can produce linear polarization. Switching can also be applied, for example, to produce RHCP for 135-180 degrees sub-cells switched off.

Figure 11A:
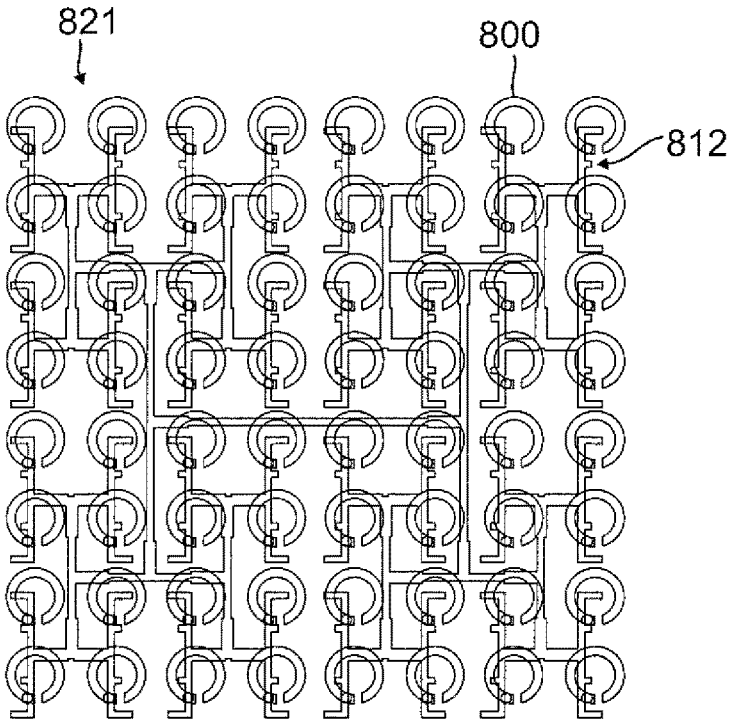
FIG. 11A is a physical layout diagram illustrating an array of annular ring reconfigurable antenna elements and their feed network, in accordance with one or more embodiments.
Figure 11B:
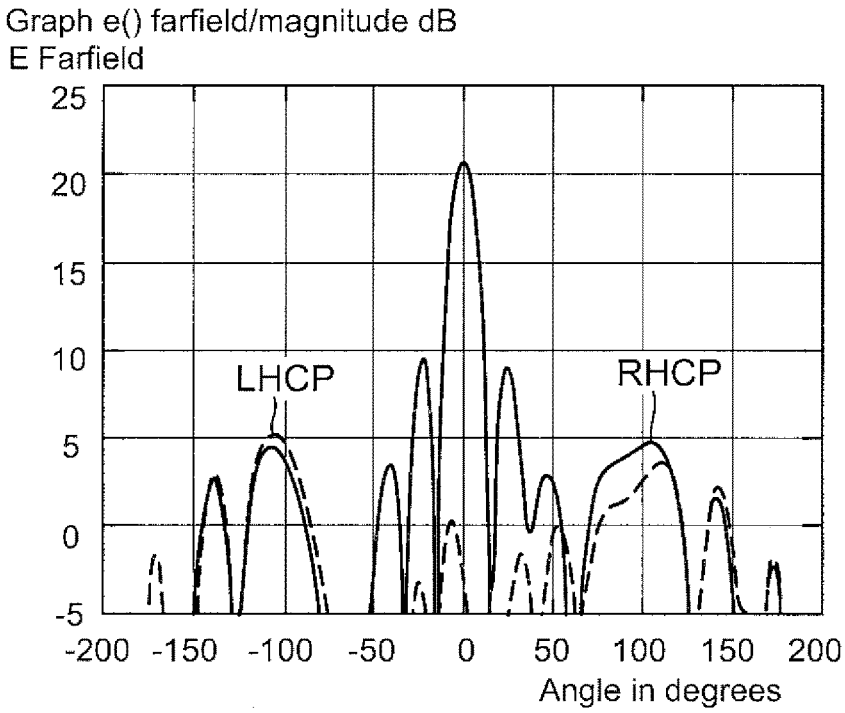
FIG. 11B is a cross-polarization diagram illustrating operating characteristics for the antenna array shown in FIG. 11A, in accordance with one or more embodiments.

FIG. 11A is a physical layout diagram illustrating an array of annular ring reconfigurable antenna elements 800 and their feed network 812, in accordance with one or more embodiments; FIG. 11B is a cross-polarization diagram illustrating operating characteristics for the antenna array shown in FIG. 11A, in accordance with one or more embodiments. FIGS. 11A and 11B illustrate reconfigurable antenna pattern switchable radiating antenna elements 800 extended to a large screen 821 of cells 802 that can be in aggregate programmed to form an array of reconfigurable antenna patterns (radiating antenna elements 800), and in turn, that can perform beam forming, beam shaping, and beam pointing functions that are all controlled digitally. The cross polarization may be better than 20 dB; side lobe suppression may be better than 10 dB; the array gain may be about 21 dBi as shown FIG. 11B.

Figure 12B:
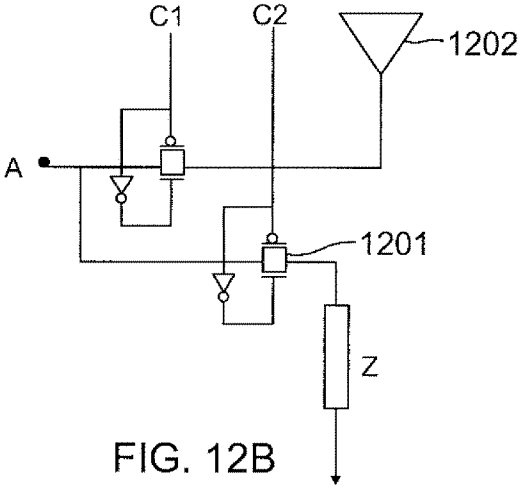
FIGS. 12A and 12B are circuit diagrams illustrating radio frequency (RF) signal routing controllers, in accordance with one or more embodiments.
Figure 12A:
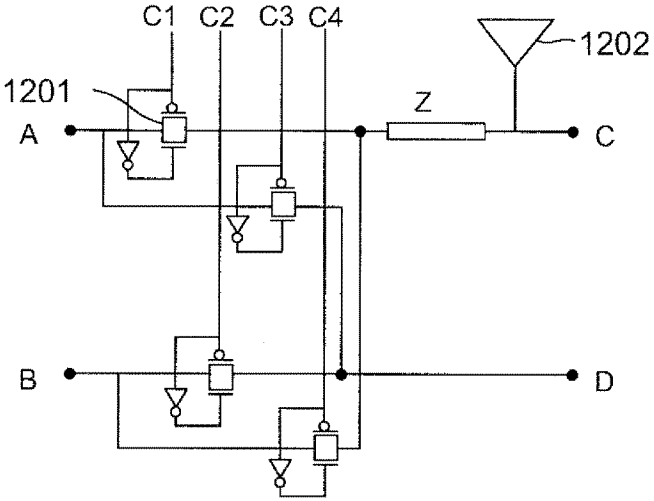

FIGS. 12A and 12B are circuit diagrams illustrating radio frequency (RF) signal routing controllers for reconfigurable antenna pattern switchable cells (or pixelate cells), in accordance with one or more embodiments. The complementary metal oxide semiconductor (CMOS) devices fabricated in a very low cost process provide a switching matrix and a simple controller that can re-arrange the RF signal routing to configure a desired band. The CMOS switch/controller chip can occupy a very small area, hence, may be an ideal solution for small metal pitch (see FIG. 4). FIG. 12A describes a differential path universal circuit diagram of one element (switchable cell, e.g., cell 401, cell 802) such that based on a desired configuration of an array, the RF signal is passed through the matching impedance Z (node C) or alternatively bypassed to the next stage(s) (node D) of antenna elements implemented in reconfigurable antenna pattern's cells. FIG. 12B shows a schematic for a programmable switchable pixelate cell (e.g., pixelate cell 304, switchable cell 802) that can terminate with a single end (or has single-ended termination) for transmitting-receiving RF signals. The cross switch architecture shown in FIGS. 12, 13, and 14 (devices 1201 act as switches to the RF signal path, radiating elements are shown as nodes 1202) enables flow of the RF signal from or to antenna array be programmed to bypass undesired reconfigurable antenna pattern's cells, hence the frequency band associated with them.

In one implementation of using CMOS (FIG. 12A), the RF input can flow from the node "A" to node "C", if logic level "C1" is set to a "zero" and logic levels "C2", "C3", and "C4" are set to a "one". Similarly, the RF signal can flow from node "B" to "D", or node "B" to "C", or node "A" to "D" by properly sequencing the logic levels. It should be noted that for very low on-channel resistance of the pass switches 1201, DMOS or JFET devices can also be used as replacements. For a long chain of switches 1201, on-channel resistance of an ohm or lower may be required.

A modified version of routing switch is shown in FIG. 12B, where, upon selecting a cell (e.g., radiating pixel element 1202), the RF signal will be delivered to that cell. Upon disabling the cell, the RF signal is terminated (e.g., passed through impedance Z to ground) such that there will be no reflections. In this configuration, all cells of the reconfigurable antenna pattern radiating antenna element are subject to activation or termination depending on the desired antenna pattern.

Figure 13B:
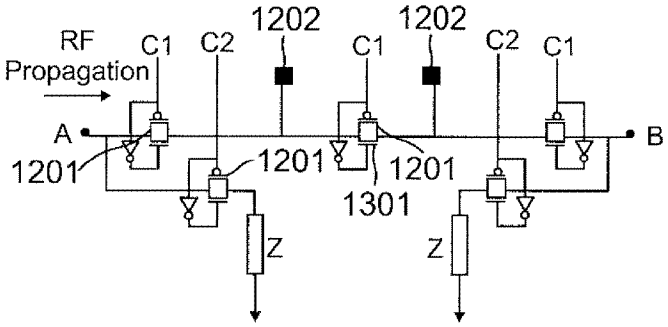
FIGS. 13A and 13B are circuit diagrams illustrating a comparison of RF signal routing controllers without and with, respectively, pixelate cell intra-connection, in accordance with one or more embodiments.
Figure 13A:
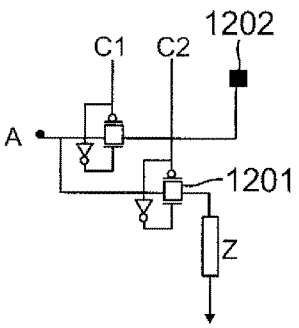
Figure 15:
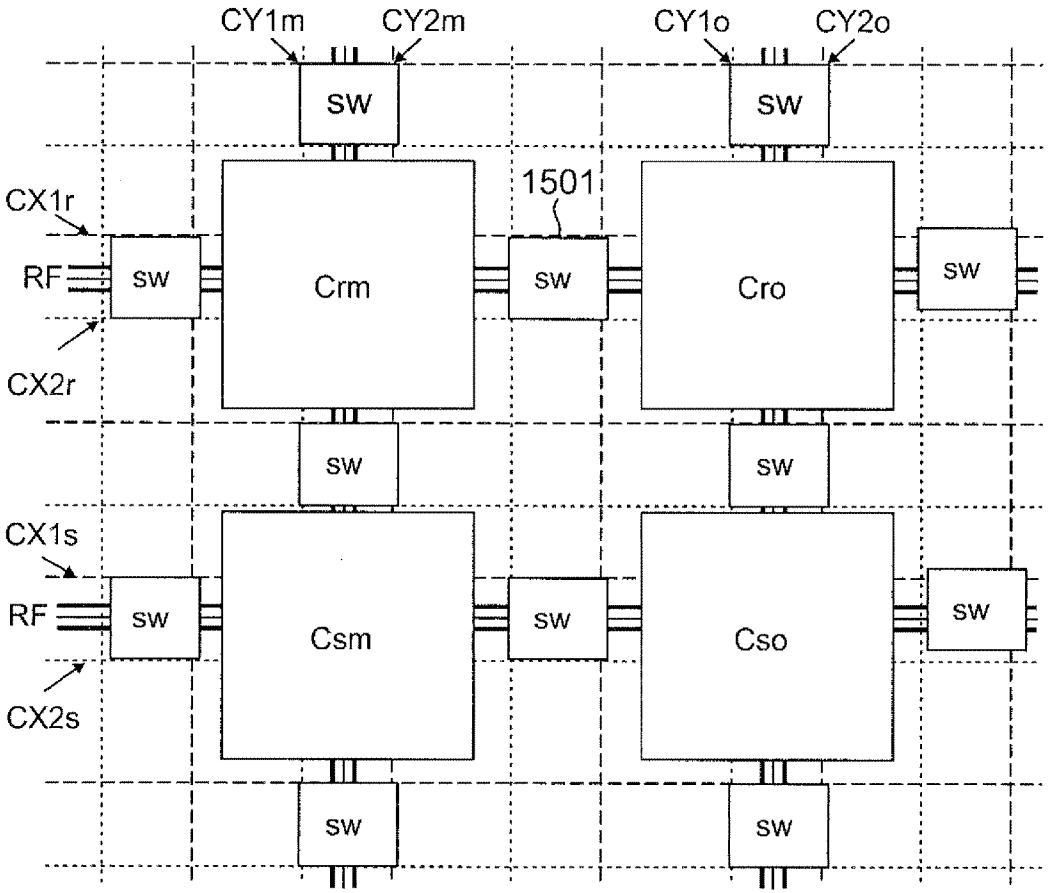
FIG. 15 is a circuit block diagram illustrating an implementation of interconnected switch clusters and antenna elements, in accordance with one or more embodiments.

FIGS. 13A and 13B are circuit diagrams illustrating a comparison of RF signal routing controllers without and with, respectively, cell intra-connection, in accordance with one or more embodiments. FIG. 13A shows a switching circuit for isolated cells proximity coupling, similar to the circuit shown in FIG. 12B. FIG. 13B shows a switching circuit for cells hard wired intra-connect at RF pass switch 1301. The cell's intra-connection makes the routing more complex as shown in FIG. 13B, where, the 1-D (one dimensional) presentation of de-select and select are shown. A more sophisticated version enables the cell to be grounded instead of being floated while the switch routes the RF to the matching load. Additionally, to have an effective antenna plate radiation efficiency, all selected cells need to be intra-connected; hence, a realistic implementation is shown in FIG. 15. The solid black boxes 1202 (and Crm through Cso in FIG. 15) represent each cell's radiating element and the routing of selected column and row clocks to select or de-select a cell is also shown.

Figure 14:
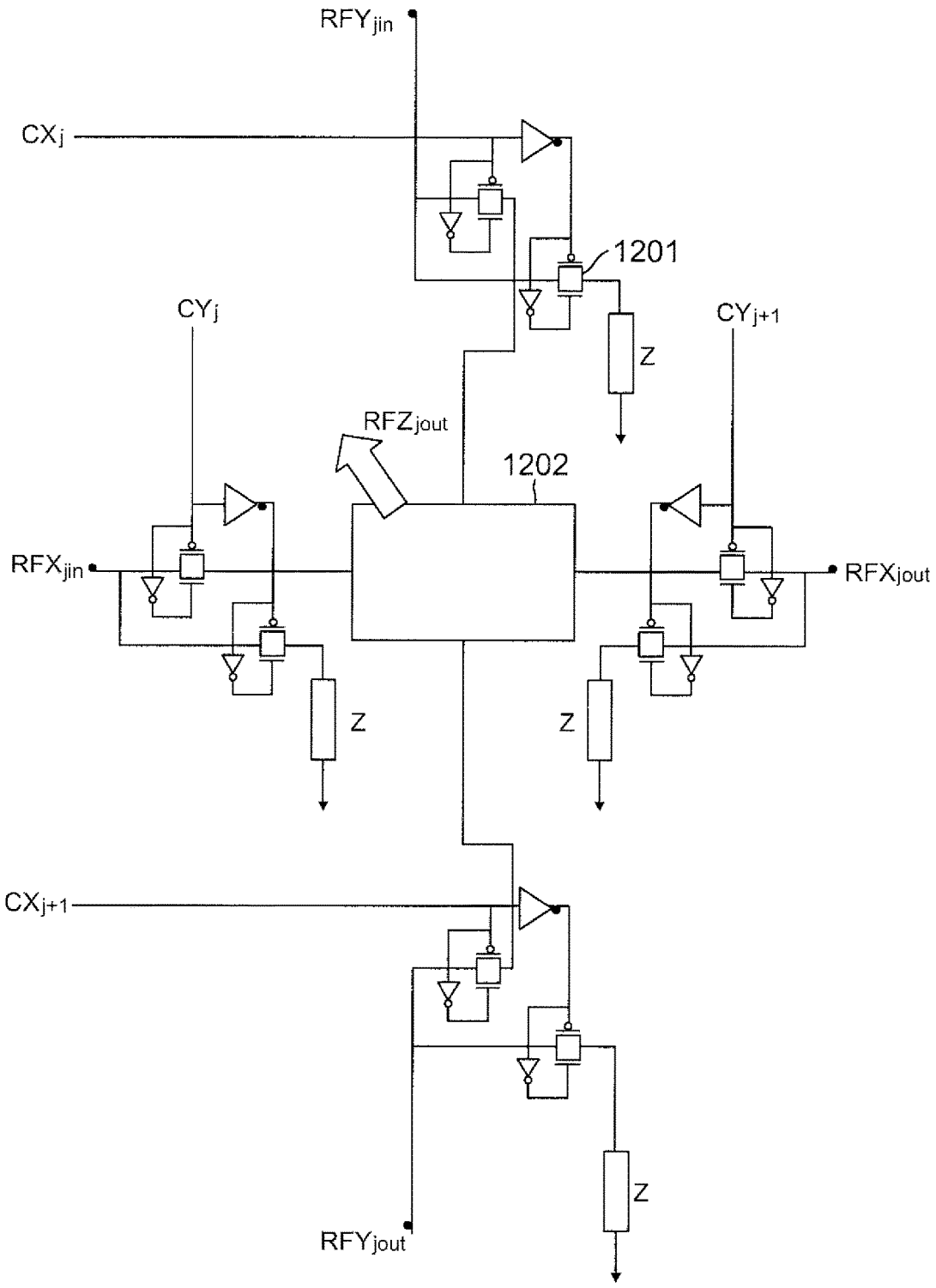
FIG. 14 is a circuit diagram illustrating a programmable RF signal routing switch cluster, in accordance with one or more embodiments.

FIG. 14 is a circuit diagram illustrating a programmable RF signal routing switch cluster with termination, in accordance with one or more embodiments. Implementation of the cluster of routing switches 1201 for a switchable cell (with radiating element 1202) is shown in FIG. 14, where upon selecting a cell, the RF will be delivered to that cell, collected from the cell and passed to the next cell. Alternatively, the cell can be de-selected and removed from the radiation contribution by the de-select function. In this configuration, some cells of reconfigurable antenna pattern are subject to activation or termination depending on the desired antenna pattern. The sophisticated implementation of switch clusters shown in FIG. 14 enables the cell (e.g., radiating element 1202) to be grounded instead of being floated while the switch routes the RF to the matching load. Additionally, to have an effective antenna plate radiation efficiency, all selected cells need to be intra-connected; hence, a realistic implementation, as noted above, is shown in FIG. 15.

FIG. 15 is a circuit block diagram illustrating an implementation of interconnected switch clusters (SW) and antenna elements (Crm, Cro, Csm, Cso) forming a reconfigurable antenna pattern, in accordance with one or more embodiments. The cells' intra-connection (e.g., SW 1501 interconnecting Crm and Cro) makes the routing more complex as shown in FIG. 13B, where the 1-D presentation of de-select and select are shown. While routing of the control clocks vertically and horizontally (Cx1r, Cx2r, Cy1m, Cy2m, etc.) to select or de-select specific cells in the reconfigurable antenna pattern may look complex, it can be implemented as a straightforward repetitive layout design and implementation.

Figure 16:
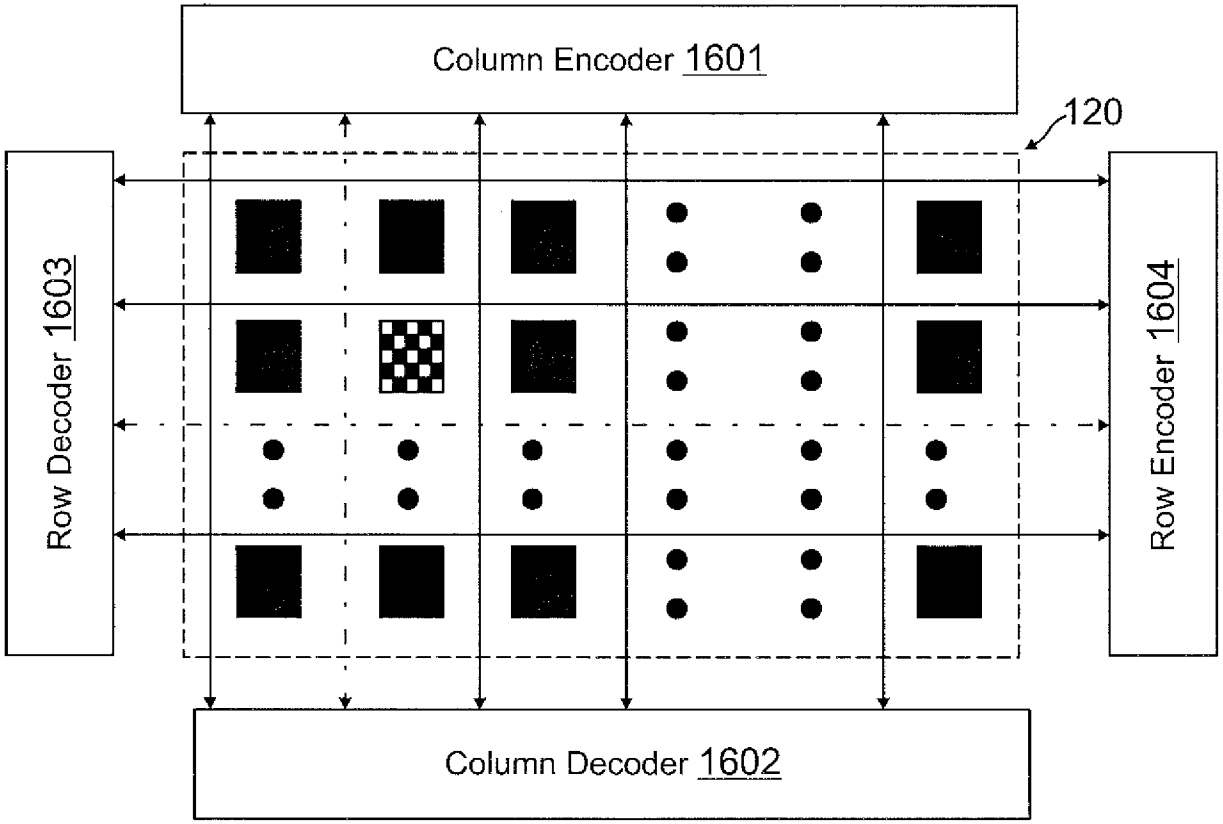
FIG. 16 is a system block diagram illustrating a reconfigurable antenna array with controllers for beam forming and steering, in accordance with one or more embodiments.

FIG. 16 is a system block diagram illustrating a reconfigurable antenna array 120 with controllers (e.g. column encoder 1601, column decoder 1602, row decoder 1603, row encoder 1604) for beam forming and steering, in accordance with one or more embodiments. Many cell based electronics systems such as thin film display monitors or semiconductor memories such as dynamic random access memory (DRAM) employ a design that may be described as a sea of unit micron size elements (cells, e.g., pixels for a display, registers or flip-flops for a memory) in large scale arrays. Each row and column is then accessed by digital logic and the electronic state of the cell is then changed. In one or more embodiments analogously, the micron to centimeter size antenna cells may be integrated to form the plate of an antenna. This radiating antenna plate can be reconfigured and its radiating plate reformed to a specific pattern as an element of a larger array of antennas in wafer scale form. FIG. 16 demonstrates the placement of the reconfigurable antenna pattern to form an array for beam forming and steering using, for example, phase and amplitude management.

Figure 17:
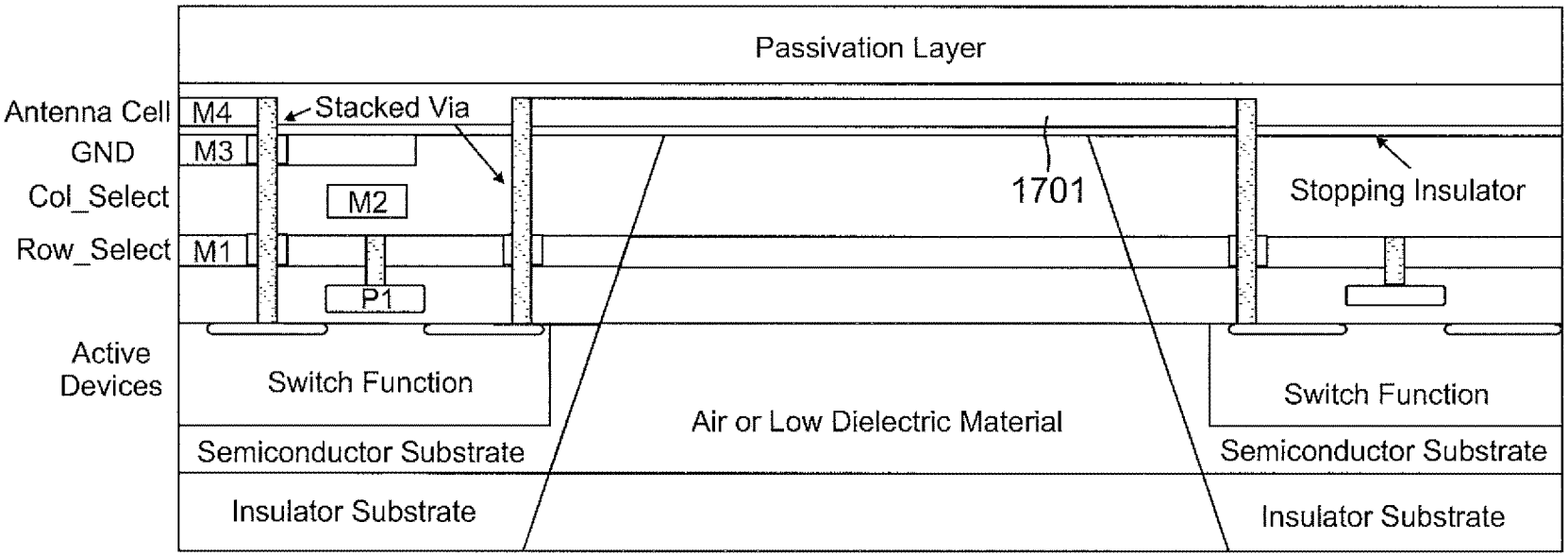
FIG. 17 is cross-sectional diagram of a silicon-on-insulator (SOI) implementation for wafer scale switchable antenna elements, in accordance with one or more embodiments.

FIG. 17 is cross-sectional diagram of a silicon-on-insulator (SOI) implementation for wafer scale switchable antenna elements, in accordance with one or more embodiments. Reconfigurable antenna pattern systems can be implemented as an integration of cells in a single substrate that reduces the wiring and bonding requirement of individual cells. One advantage of such programmable antenna elements in an array is the capability of integrated functionality that is reconfigurable.

In one implementation, reconfigurable antenna pattern system 100 (e.g., building blocks 110) can be manufactured as a semiconductor chip. System 100 can be scaled by integrating a sea of the chips to form the final antenna plate (e.g., array 120) with available control signals to and from row and column select switches (FIGS. 15, 16). The row and column select and associated CMOS switches may be integrated in the same substrate. The shared pins of cells to implement a patch antenna may be RF, pass-through, block, row-select, column-select, and ground.

A fully semiconductor wafer implementation of a wafer scale reconfigurable antenna pattern is shown in FIG. 17, where the CMOS analog switches with very low on-resistance (10-100 milli-Ohm) and isolations of 20-30 dB have been reported.

In this implementation, a silicon-on-insulator (SOI) manufacturing process may be optimal inasmuch as each cell can be isolated from the substrate, where spurious coupling to the switches are minimized or even eliminated. Furthermore to place the array on a planar surface, further modification can be accommodated such that a back-side etch of the cell plates (e.g., cell plate or radiating pixel element 1701 as shown in FIG. 17) can further enhance the radiation coupling to the air. A CMOS process with one poly layer and four metal layers may be sufficiently cost-effective for implementation of such wafer scale reconfigurable antenna pattern. It is important to note that there is a need for processing of a special metal layer (e.g., copper) to accommodate the large area radiating elements such as cell plate 1701. A separate masking process or electroplating step may be introduced to the standard manufacturing flow to avoid over etching of fine pitch RF metals, e.g., metal routing for RF signal feed lines.

Figure 18:
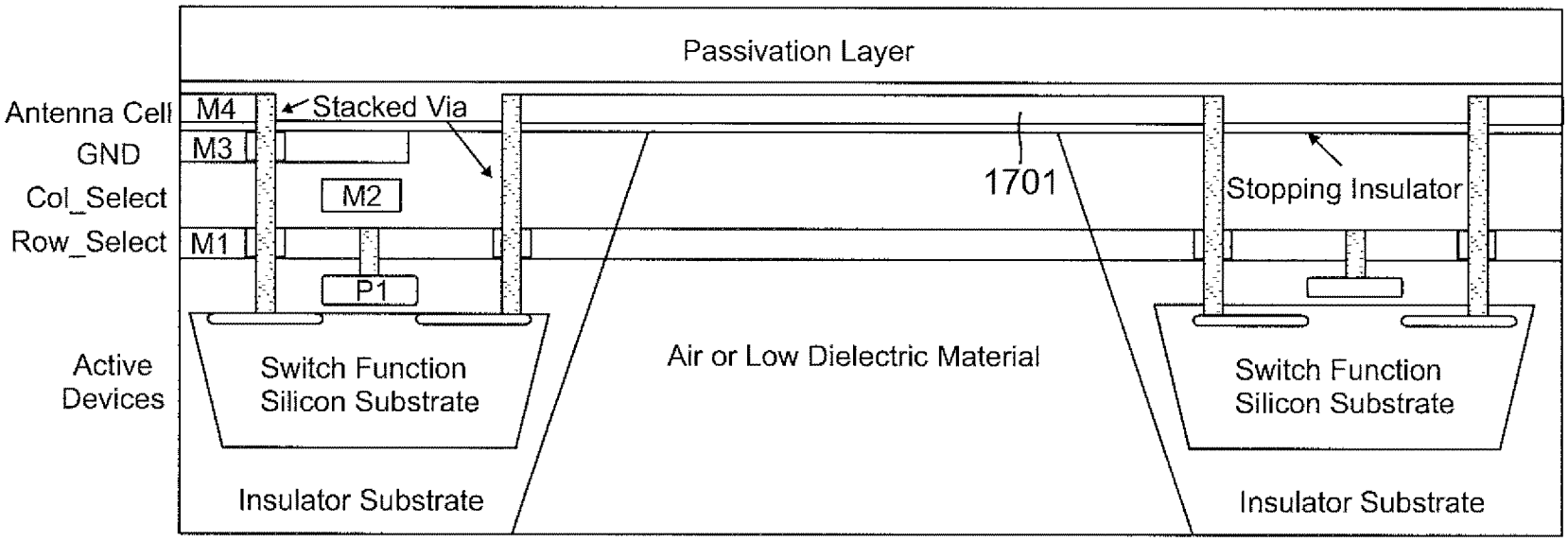
FIG. 18 is a cross-sectional diagram of a modified silicon-on-insulator (SOI) implementation for wafer scale switchable antenna elements, in accordance with one or more embodiments.

FIG. 18 is a cross-sectional diagram of a modified silicon-on-insulator (SOI) implementation for wafer scale switchable antenna elements, in accordance with one or more embodiments. One implementation of wafer scale reconfigurable antenna pattern system 100 may employ a modification of a standard SOI process with steps to address electroplating the cell radiation plates (e.g., radiating pixel elements or cell plates 1701), while the rest of the manufacturing addresses CMOS processes for switching and other components. Such a modified process, which provides a manufacturing process for highly isolated wafer scale reconfigurable antenna patterns, may yield a cross section such as that shown, for example, in FIG. 18.

The process may include steps, for example, that include:

1) a modified standard SOI CMOS process with inclusion of a thin layer of oxynitride (NOx) layer;
2) skipping the pad opening mask, using an additional metal 4 mask (4a);
3) depositing metal 4a by sputtering, e-beam or electrolyte methods (10 micron);
4) depositing low temperature porous oxide;
5) masking an over sized cell dimension and etching back the undesired areas;
6) depositing a second layer of passivation oxide;
7) using infrared camera and marked fiducials, masking the backside of the wafer for deep etch under cell plates;
8) after deep silicon etch, using a highly porous oxide to flow into the deep trenches;
9) back polishing;
10) using an optional shallow trench etch to isolate the switches;
11) etching back the top passivation layer to open the pads for bonding; and
12) a final annealing step to suppress surface states.

Embodiments described herein illustrate but do not limit the disclosure. It should also be understood that numerous modifications and variations are possible in accordance with the principles of the present disclosure. Accordingly, the scope of the disclosure is best defined only by the following claims.

What is claimed is:

1. A system comprising:

a matrix of antenna pixelate cells wherein each pixelate cell either transmits a radio frequency (RF) signal to air or terminates routing of the RF signal based on switching of the pixelate cells, wherein at least one of the pixelate cells comprises a plurality of switchable ring segments arranged as a segmented annular ring forming a single antenna element that is reconfigurable according to which switchable ring segments are switched on or off; and wherein the plurality of switchable ring segments are switched such that the segmented annular ring is configured to transmit the RF signal as one of a left-hand circular polarization (LHCP) signal, a right-hand-circular polarization (RHCP) signal, or a linear polarization signal; and the matrix forms a reconfigurable antenna pattern that provides a specific antenna pattern based on which specific pixelate cells are switched to transmit and which specific pixelate cells are switched to terminate.

2. The system of claim 1, further comprising:

a feed network connected to the antenna pixelate cells so that beam forming is provided for a specific antenna pattern, and wherein:

beam steering and beam shaping are effected based on which specific pixelate cells are switched to transmit and which specific pixelate cells are switched to terminate.

3. The system of claim 1, further comprising:

a feed network connected to the antenna pixelate cells so that spatial power combining is provided for the specific antenna pattern.

4. The system of claim 1, further comprising:

a feed network connected to the antenna pixelate cells such that beam steering is produced for the specific antenna pattern based on varying a phase and an amplitude of the signal fed to each of the one or more single antenna element, polarized pixelate cells.

5. The system of claim 1, wherein the reconfigurable antenna pattern is ring based such that each of the plurality of pixelate cells comprises a reconfigurable segmented annular ring.

6. The system of claim 1, wherein the switchable ring segment is switched off bypassing the RF signal fed to the switchable ring segment through an impedance to ground.

7. The system of claim 1, further comprising:

an array of ring based reconfigurable antenna patterns acting as elements of a wafer scale antenna module with right hand circularly polarized (RHCP), left hand circularly polarized (LHCP), or linear polarization performance.

8. The system of claim 1, further comprising:

an array of reconfigurable antenna patterns acting as elements of a wafer scale antenna module of a single or multiple frequency transmitter and receiver.

9. The system of claim 1, further comprising:

an array of reconfigurable antenna patterns acting as elements of a wafer scale antenna module arranged as rows and columns of antenna pixelate cells, the array being configurable based on selecting which specific pixelate cells are switched to transmit and which specific pixelate cells are switched to terminate; and row and column selected pixelate cells are switched in real time using a controller.

10. The system of claim 1, further comprising:

an array of reconfigurable antenna patterns acting as elements of a wafer scale antenna module arranged as rows and columns of antenna pixelate cells, the array being configurable based on selecting which specific pixelate cells are switched to transmit and which specific pixelate cells are switched to terminate; and row and column selected pixelate cells are switched using a non-volatile memory arrangement.

11. The system of claim 1, further comprising:

an array of reconfigurable antenna patterns acting as elements of a wafer scale antenna module arranged as rows and columns of antenna pixelate cells, the array being configurable based on selecting which specific pixelate cells are switched to transmit and which specific pixelate cells are switched to terminate; and all selected pixelate cells are intra-connected.

12. The system of claim 1, wherein the matrix of antenna pixelate cells is implemented on a single wafer.

13. A method of manufacturing a wafer scale reconfigurable antenna pattern of claim 1, the method comprising:

using a single poly silicon-on-insulator (SOI) process for forming switch and radiating pixel elements;

using a 4 layer metal process for forming row select, column select, ground, and antenna radiating pixel elements; and using a back etch process to the antenna radiating pixel element for enhancement of antenna radiating pixel element radiation coupling.

14. A method comprising:

switching each of a plurality of antenna radiating elements either to an RF signal or to a termination so that selected radiating elements switched to the RF signal are arranged in a selected one of a plurality of antenna patterns that can be formed from the plurality of antenna radiating elements, wherein at least one of the antenna radiating elements comprises a plurality of switchable ring segments arranged as a segmented annular ring forming a single antenna element that is reconfigurable according to which switchable ring segments are switched on or off; and wherein the plurality of switchable ring segments are switched such that the segmented annular ring is configured to transmit the RF signal as one of a left-hand circular polarization (LHCP) signal, a right-hand-circular polarization (RHCP) signal, or a linear polarization signal.

15. The method of claim 14, wherein the radiating elements are elements arranged as an array, and the selected antenna pattern is any possible pattern formed by selecting a subset of the array as the selected radiating elements switched to the RF signal.

16. The method of claim 14, wherein the radiating elements are patch elements arranged as an array, and the selected pattern act as elements of an antenna with right hand circularly polarized (RHCP), left hand circularly polarized (LHCP), vertical, horizontal, or linear polarization performance.

17. The method of claim 14, wherein the radiating elements are dipole elements arranged as an array, and the selected pattern act as elements of an antenna with right hand circularly polarized (RHCP), left hand circularly polarized (LHCP), vertical, horizontal, or linear polarization performance.

18. The method of claim 14, further comprising feeding the RF signal through a feed network to the antenna radiating elements and varying a phase and an amplitude of the signal fed to each of the two or more antenna radiating elements such that beam steering is produced for the selected antenna pattern.

19. The method of claim 14, further comprising:

reconfiguring an antenna in real time by altering the selection of radiating elements switched to the RF signal.

* * * * *